United States Patent [19]

Chopp

[11] 3,990,702

[45] Nov. 9, 1976

[54] RACQUET GAME

[76] Inventor: Peter G. Chopp, 9001 Golf Road, Des Plaines, Ill. 60016

[22] Filed: Oct. 10, 1975

[21] Appl. No.: 621,488

[52] U.S. Cl. ..... 273/95 R; 273/113

[51] Int. Cl.[2] ..... A63B 71/02

[58] Field of Search ..... 273/91, 95 R, 96 R, 273/108, 109, 113, 115, 116, 118 R, 119 R, 120 R, 121 R, 122 R, 123 R, 124 R, 125 R, 73 C, 73 D, 67 R

[56] References Cited

UNITED STATES PATENTS

| | | | |
|---|---|---|---|
| 293,573 | 2/1884 | Greenough | 273/73 D |
| 1,560,026 | 11/1925 | Dickson | 273/96 R |
| 2,409,373 | 10/1946 | Mautner | 273/113 |
| 3,188,087 | 6/1965 | Larson | 273/115 |
| 3,563,550 | 2/1971 | Saunders | 273/113 |
| 3,647,215 | 3/1972 | Sterlicchi | 273/126 R |

*Primary Examiner*—Anton O. Oechsle
*Assistant Examiner*—Marvin Siskind
*Attorney, Agent, or Firm*—Johnson, Dienner, Emrich & Wagner

[57] ABSTRACT

A paddle or racquet and ball combination is disclosed that is characterized by the provision of a plurality of ball-retaining holes in the face of the racquet having indicia representing a different game on each side arranged in a relationship to the difficulty in catching the ball therein when it is caught on the racquet by a player. The racquet has a flange around its periphery with one or more protruding tabs that are adapted to receive and hold conforming overlays or panels bearing different indicia whereby the racquet and ball combination can be used to play a number of games. In one embodiment, a single tab is used to hold one or more overlays or panels of thin sheet material and the panels are provided with a neck portion that extends into the handle whereby the neck portion is in a natural position to be held by the thumb of the player. The device can be used for such games as baseball, number games, tennis and bowling. In another embodiment, the tab or tabs used to retain the overlays are so shaped and positioned as to deflect the ball and cause erratic rolling about the face of the racquet thereby increasing the dexterity required to score. Also a feature of the invention is the provision of a beveled or rounded inside surface on the peripheral flange against which the ball rolls and bounces. The device can be used either as an amusement or educational toy.

11 Claims, 8 Drawing Figures

FIG. 1
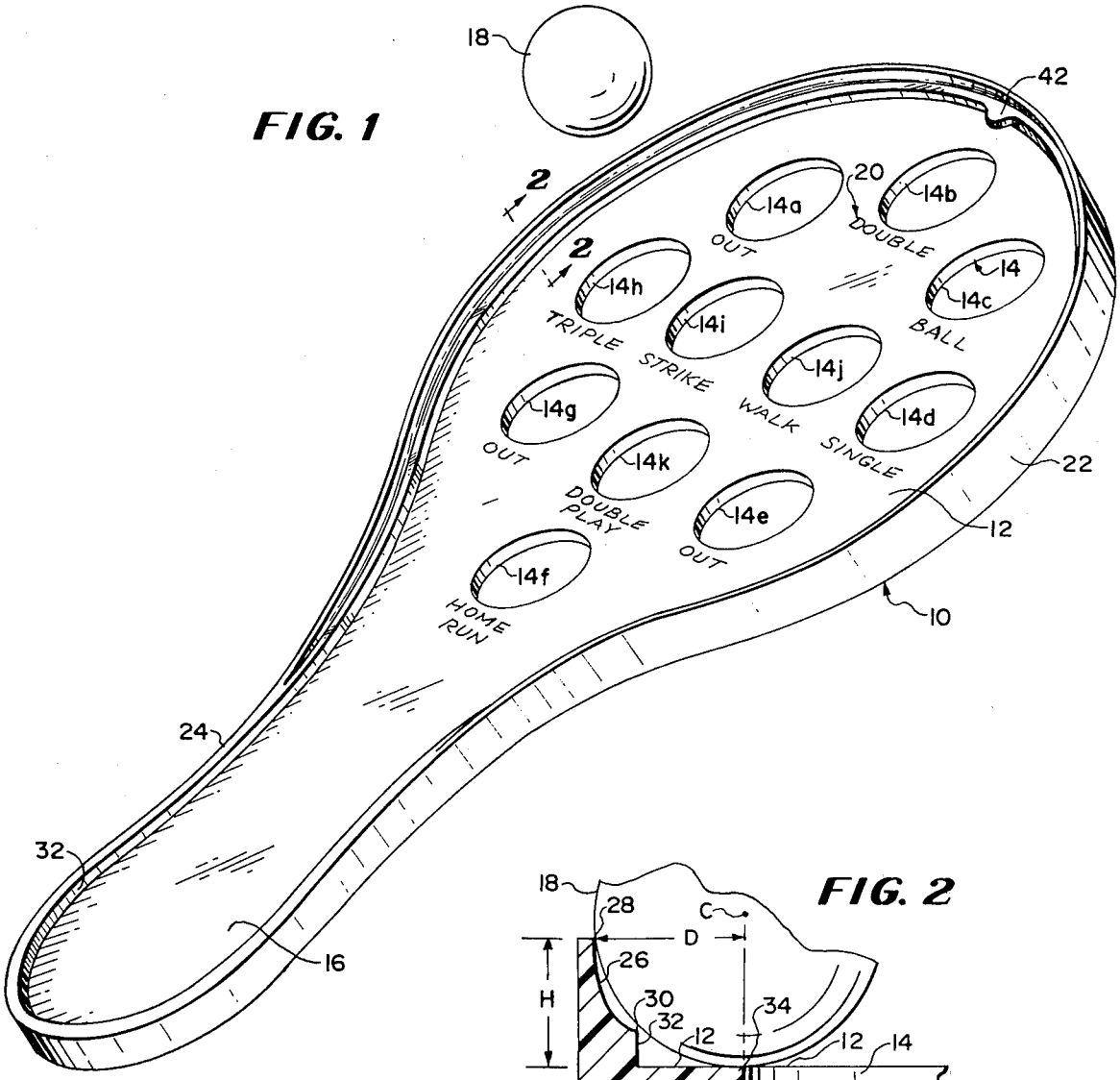
FIG. 2
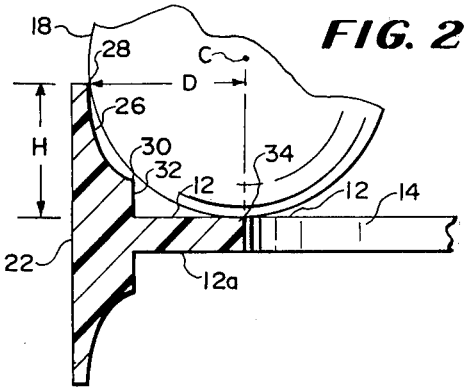
FIG. 2A
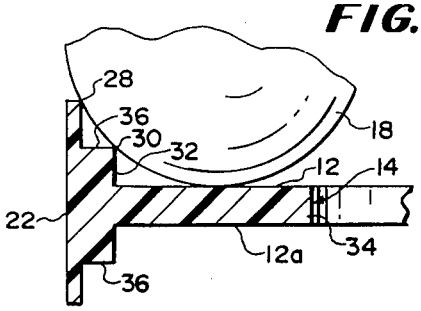
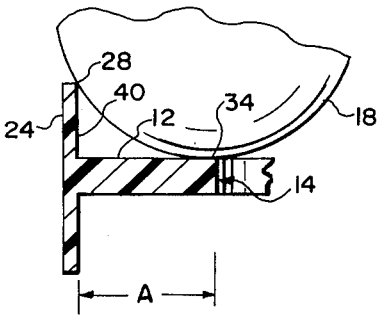
FIG. 2B

FIG. 4A
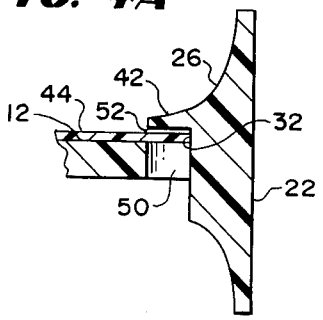
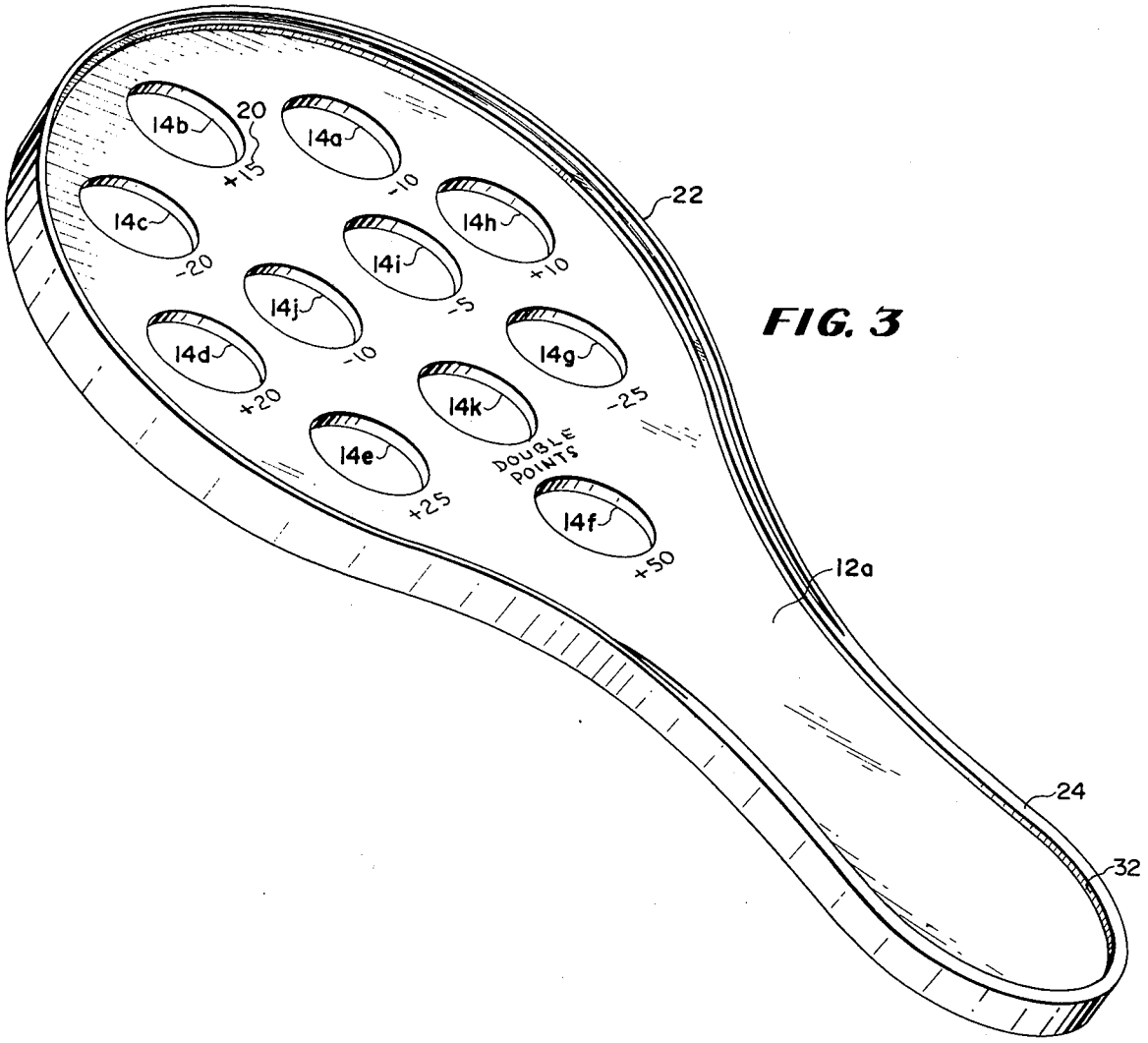
FIG. 3

RACQUET GAME

BACKGROUND OF THE INVENTION

The combination of a racquet or paddle and ball for use in playing games is old. It is also known to provide holes in the face of the racquet or paddle for the purpose of catching a ball thereon. Illustrative patents in this art are Dickson, U.S. Pat. No. 1,560,026; Voelker, U.S. Pat. No. 1,582,104; Thompson, U.S. Pat. No. 1,598,896; Carballal, U.S. Pat. No. 2,242,450; and O'Brien, U.S. Pat. No. 3,012,785. Holes are also placed in the faces of various molded plastic paddles for the purpose of decreasing their wind resistance during use. Various numbers, color codes and markings appear on some of the prior art paddles adjacent the holes for the purpose of scoring points or playing games.

SUMMARY OF THE PRESENT INVENTION

In experimenting with a number of these products, it was found that the shape and structure of the paddle surface, the placement of the ball-receiving holes in the paddle face and the indicia used to score points or play a game left a lot to be desired as far as continued interest in the game was concerned, especially for children. Also, the substance of the games disclosed and the manner of play, were limited and as a result, interest in the device tended to lag, particularly as one became skilled in manipulating the ball into a desired position or opening on the upper face of the paddle.

As a result of this experience, the instant racquet and ball game was conceived wherein a deflecting peripheral flange is provided around the edge of the paddle and extending substantially normal to each face. Inside this flange a secondary off-set flange or bevel is provided as an alternative construction. Either flange can carry one or more inwardly directed tabs or protuberances which are closely spaced from the face of the racquet.

A plurality of holes is provided in the face of the racquet spaced from each other and from the flanges. These openings are circular and have diameters less than the diameter of the play piece which can be a rubber ball or the like or a Ping Pong ball. Although the number of such openings in the face of the racquet is not critical, in one embodiment, 11 such openings are used and arranged in an asymmetrical pattern with unequal distances center-to-center about the arrangement.

The holes each have indicia adjacent thereto and applied to the face of the racquet whereby one game can be played by using one side of the racquet and another game played by using the other side.

Either flange arrangement serves a dual purpose, that of retaining and deflecting the ball or play piece and as a retainer for a series of panels bearing changed indicia for a different type of amusement or educational play. The panels are shaped and sized so as to snap-fit along the edge and include conforming openings so as to exactly match the play surface of the racquet.

Each panel is opaque so as to block out the indicia on the face of the racquet and is composed of flexible light weight sheet material. In one embodiment the overlays include a portion that extends into the handle part of the racquet whereby all or a part thereof is held naturally by the hand or thumb of the player as the sole means for retaining the overlay in place. Alternatively, the rounded edge of the panel can fit under one or more tabs that extend from the peripheral flange as additional holding means. These and other embodiments or the invention will be described or become apparent as the description proceeds.

DESCRIPTION OF THE DRAWINGS

Illustrative embodiments of the invention are shown in the drawings wherein:

FIG. 1 is a top perspective view of the racquet of this invention showing a ping-pong ball play piece about to strike the surface thereof during play, said surface bearing indicia adjacent the holes for a baseball game.

FIG. 2 is a fragmentary cross-sectional view taken along the lines 2—2 of FIG. 1 to show the relationship of the inner surface of the flange and an adjacent opening in the surface of the racquet with the periphery of a Ping Pong ball or other spherical play piece.

FIGS. 2A and 2B are cross-sectional views similar to FIG. 2 showing different relationships between the play piece and the outer flange surface.

FIG. 3 is top perspective view of the other side of the racquet shown in FIG. 1 with the top surface bearing indicia for a numbers game involving algebraic sums.

FIG. 4A is a cross-sectional view along the lines *4a–4a* of FIG. 3, and, FIG. 5 is a top perspective view of a panel bearing indicia for the game of tennis, which may be the reverse side of the panel shown in FIG. 4.

DESCRIPTION OF THE PREFERRED EMBODIMENTS

Figure 4:
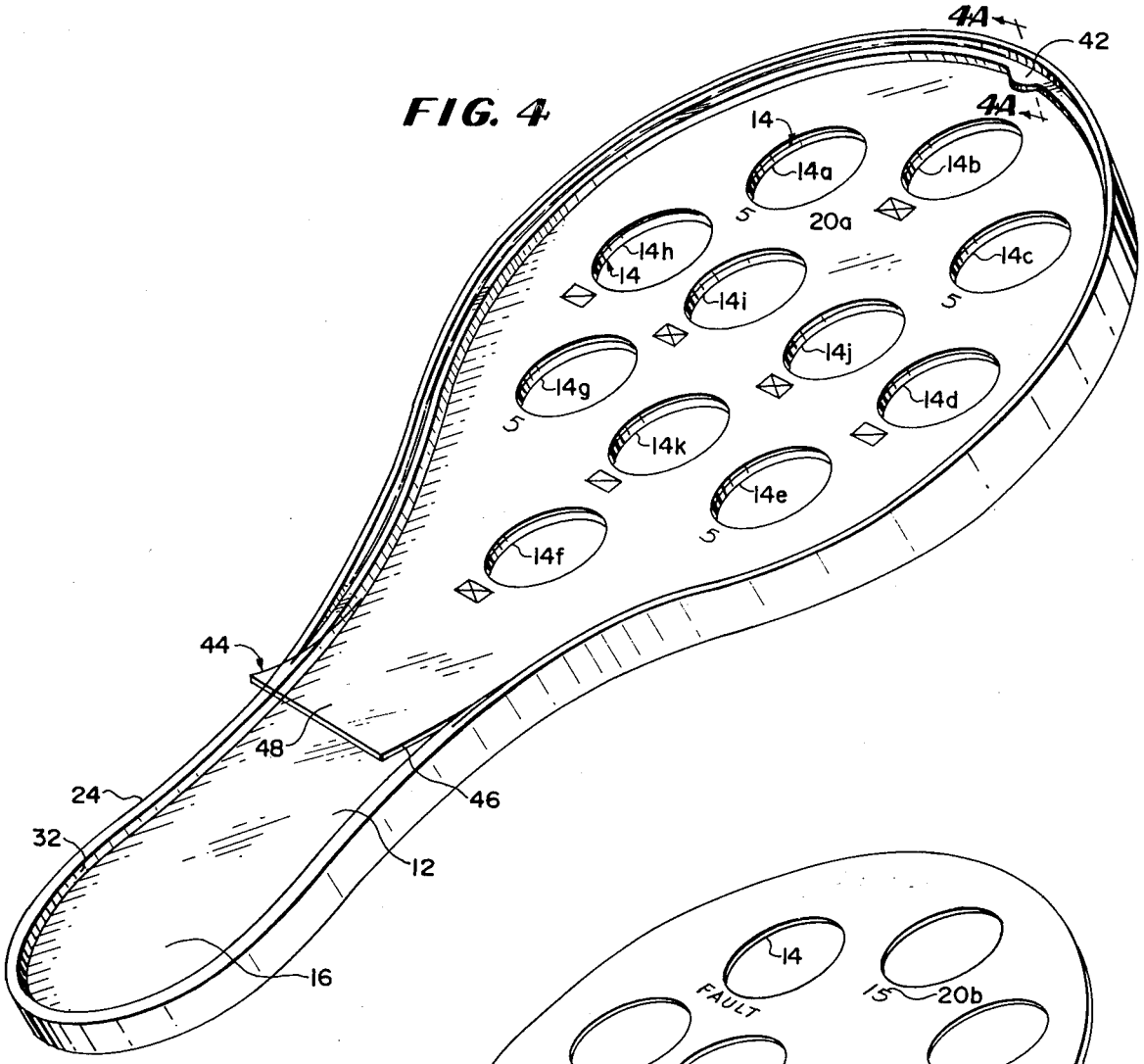
FIG. 4 is a top perspective view of the racquet of FIG. 1 with a panel thereon bearing indicia adjacent the holes for a bowling game and illustrating the use of a single tab to hold the overlay in place.

Referring to the drawings, wherein like parts bear the same numerals, the racquet 10 is shown in FIG. 1 with the play surface 12 uppermost and in FIG. 3 with the other or reverse side 12*a* uppermost each of said sides being used to play a different game. For this purpose the rounded or oval-shaped planar play surfaces 12 and 12*a* of the racquet 10 have the plurality of particularly spaced and arranged holes therethrough and includes the integral narrow handle portion 16. The play piece 18 is spherical, having a diameter greater than the diameters of the holes 14. Indicia 20 below each hole identify the score or result obtained when the play piece 18 is caught therein. The manner of play is aided by the integral flange 22 which extends symmetrically around the oval-shaped play surfaces and extends in the form of a lesser flange 24 around the handle portion 16. The racquet is preferrably formed of high impact polystyrene or an equivalent plastic which is characterized by its toughness and rigidity.

The play piece 18 may be a rubber ball or the like and preferably, because of its distinctive bounce, uniformity of curvature, and lightness of weight is a Ping Pong ball. The objective of the combination of racquet 10 and play piece 18 is to toss the play piece 18 in the air or bounce it on the floor or a table top with one hand and catch it in one of the holes 14 on the playing surface 12.

A non-limiting feature of the invention is the incorporation of a flange around the periphery of the playing surface which has at least one inside point or edge of contact with the play piece 18 as it rolls or bounces there against, while at the same time allowing the play piece to be deflected along the outer edges of the peripheral holes in the array through the face of the racquet.

For this purpose the inside surface of the flange 22 defines one or more points of contact with the play piece 18 which bear a particular relation therewith as the play piece rolls along the inside of the flange or bounces there against.

This is illustrated in FIG. 2 which shows the play piece 18 resting on the play surface 12 opposite one of the peripheral holes 14. The inside of the flange 22 has the concave rounded surface 26 extending from the top inside edge 28 to the lower inside edge 30 and further defines the inside shoulder 32 which is normal to the play surface 12. The effective height H of the flange 22 above the surface 12 is less than the radius of the spherical play piece 18 and the distance D from the edge or point of contact 28 to the outermost part or edge 34 of the hole 14 is equal to or slightly less than the radius of the play piece, the center of which is shown at C. The same relationship would exist if the play piece 18 were resting on the other play surface 12*a* since the flange 22 is symmetrical. These corresponding parts of the flange 22 on the side 12*a* do not therefore require description.

Thus as the play piece 18 rolls by the hole 14 adjacent the flange 22 with the paddle level or tilted slightly toward the flange, the peripheral surface of the play piece makes rolling contact with the top corner or edge 28 and its line of rolling contact with the surface 12 catches or rolls at an angle against and on the inside of the corner edge 34 of the hole 14. Since the corner 34 is inside the center C of the play piece 18 there is a tendency for the play piece to follow the curvature of the edge 34 and be deflected from the flange, and, depending on its speed of travel and attitude of the racquet, in an erratic path not necessarily causing it to roll into this particular hole or into an adjacent hole.

Preferably the play piece 18 is a Ping Pong ball since the light weight, degree of bounce and erratic roll and spin of this kind of play piece makes it more difficult to control. The play piece 18 may or may not contact the corner edge 30 or may contact the corner 30 only and be spaced from the corner edge 28, depending on its diameter.

FIG. 2A shows a cross-sectional view like FIG. 2 wherein the flange 22 has been modified to include the step or offset 36 defining the contact point or edge 30 which in this instance strikes the peripheral surface of the play piece 18 at two points. The flange 22 of FIG. 2A can be used with a play piece of the diameter of a Ping Pong ball or proportioned for use with a play piece of smaller diameter. In this embodiment, the inner edge 34 of the hole 14 is spaced from the rolling contact point 38 of the play piece.

FIG. 2B represents still another form of flange 22 having a planar inner side 40 which is normal to the play surface 12 and its top inner edge maintains the play piece 18 with its point of rolling contact at the curved edge 34 of the hole 14.

From the foregoing description of the racquet and play piece combination it is apparent that the presence of the rigidifying flange 22 on the periphery of the racquet 10 can both facilitate and hinder the catching of play piece particularly if the play piece has the bounce of a Ping Pong ball. The flange 22 being relatively high in relation to the diameter of the play piece has the tendency to retain the ball on rolling contact but is a variable factor when the play piece bounces or falls against it. Without the flange 22 the game of play is not only more difficult and discouraging but the liveliness of the action of the play piece is greatly reduced.

For convience in describing the various game arrangements for use with the racquet 10, the holes 14 are labeled 14*a* through 14*k*, there being eight peripheral holes and three innermost holes. The general relationship of the flange 22 with the peripheral holes 14*a* through 14*k* is maintained as shown in the embodiment of FIGS. 2, 2A or 2B, as desired, although these peripheral holes may be staggered slightly by using combinations of these embodiments in the construction.

As further shown in FIG. 1 the plurality or array of holes 14 is also arranged in a particular pattern or groups there being three holes 14*a*, 14*b*, and 14*c* substantially equally spaced from the flange 22 around that part of the play surface 12 most remote from the handle 16. As applied to the game of baseball, the topmost hole 14*b* bears the indicia 20 for a "DOUBLE" or two base hit, a desirable result and this hole is flanked by the holes 14*a* and 14*c* bearing the indicia "OUT" and "BALL" which are less desirable results. Alternate desirable results for hole 14*b* could be a "TRIPLE" as shown for hole 14*h* or a "SINGLE" as shown for hole 14*d* and lastly a "HOME RUN" as shown for hole 14*f*. Alternative undesirable results for holes 14*a* and 14*c* would be a "STRIKE" as shown for the intermediate hole 14*c* or the "WALK" of hole 14*j* or the "DOUBLE PLAY" of hole 14*k*.

Below the holes 14*a*, 14*b* and 14*c* there is provided the series of holes 14*h*, 14*i*, 14*j* and 14*d*, the first and last of which are peripheral holes. This series of holes is equally spaced along a transverse axis of the play surface 12 that is about mid-way between the hole 14*b* and the hole 14*f* and the indicia therefore represent both desirable results and undesirable results. Thus, a TRIPLE, STRIKE, WALK, or a SINGLE can be scored here.

Immediately adjacent the foregoing series is the row of holes 14*g*, 14*k*, and 14*e* which flank or form a formidable barrier for the HOME RUN hole 14*f* and accordingly include the indicia OUT and DOUBLE PLAY.

In the pattern shown for the game of baseball it is apparent that the 11 holes are divided about equally as far as the progress of the game is concerned there being a total of five favorable results and six unfavorable results of which two are intermediate results, namely a BALL and a STRIKE. Also it is to be observed that each favorable result is flanked by an unfavorable result and accordingly the manipulation of the play piece 18 by tilting the racquet one way or the other after the play piece 18 has been caught thereon requires skill and dexterity.

FIG. 3 is a plan view of the other side of the racquet 10 from that shown in FIG. 1. With the play surface identified as 12*a*, in this instance, the indicia 20 are plus and minus numbers involving the numbers 5, 10, 15, and 20. The objective here for each player is to score either the most negative or positive points and the arrangement can be used by children in practicing their addition and subtraction in arithmetic. After stating his or her objective the play begins and if for example a person declares then he will attempt to score the most positive points he will at each turn of play attempt to manipulate the play piece into the holes 14*b*, 14*d*, 14*h*, 14*e*, 14*k* and 14*f* and try to avoid the other five holes having negative values. However, each time he scores a negative result, he must subtract that amount from his total score. His opponent may also make the same declaration or go for the more difficult task of gaining a higher negative score. The array of indicia 20 shown is FIG. 3 includes a total of 120 positive points but only a total of 90 negative points. Thus the odds are favorable toward gaining positive points over negative points and means are provided whereby the players can be assigned with catagory of play according to their demonstrated or expected dexterities.

Here again in this array of indicia each desired result is flanked by one or more undesirable results. However, the hole 14*k* bearing the indicia "DOUBLE POINTS" is surrounded by holes that may be favorable or unfavorable to the intended or declared purpose of a player.

Figure 5:
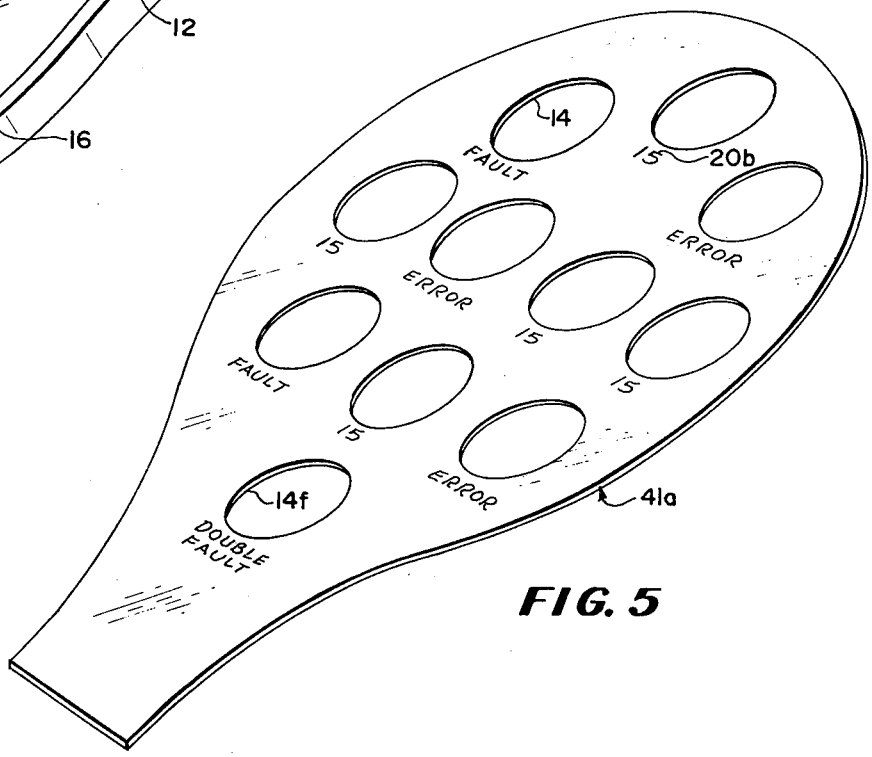

Referring to FIGS. 1, 4 and 4*a* along with FIG. 5 it is seen that the inner part of the flange 22 includes the tab member 42 on only one side of the racquet, namely on the side having the play surface 12. An overlay or panel 44 is provided in this embodiment have holes 14 therein which conform with the holes 14 of the play surface 12. The outer edge 46 of the overlay piece 42 is cut to conform with the inner surface 32 of the flange 22, see FIGS. 2 and 2A, or to conform with the inner surface 40 of the flange shown in FIG. 2B, or be slightly spaced therefrom so that it can be lightly pressed or dropped into the position shown in FIGS. 4 and 4A with the top portion thereof under the tab 42.

The panel includes an extension which fits all or part way into the handle portion 16 as shown in FIG. 4. The flange portion 24 has an extension of the surface 32 in order to engage the edge 46 in a slip fit relationship and this part or the entire edge 46 of the panel can so engage within the flange 22. This part is turned upwardly in FIG. 4 for purposes of illustration and would normally be flat upon this surface and into engagement with the surface 32.

In normally gripping the racquet one places his thumb on top of the handle portion and in this position the extension 48 can be conviently further held down during play. In this manner both ends of the panel 44 are secured and there is little or no tendency for it to come out during normal manipulations of the racquet during play. The hole 50 under the tab 42 is necessary when the racquet is molded from plastic and the hole is formed by a protrusion of the die which forms the space 52 thereunder as well as the under surface of the tab 42.

In one embodiment the hole 14*b* at the top end of the racquet is spaced downwardly from the tab 42 such that as the play piece touches the end of the tab, the rolling contact of the play piece with the play surface 12 is like that shown in FIGS. 2, 2A and 2B. The presence of the tab 42 also deflects the play piece in an erratic manner. If desired, additional tabs 42 can be located adjacent the holes 14*e* and 14*g* to not only hold the panel 46 therein but also deflect the play piece.

The panel 44 is constructed of opaque sheet material such as a colored plastic so that the indicia 20 on the playing surface 12 are hidden from view and a new set of indicia 20*a* is provided on the exposed surface of the overlay, in this instance representing the game of bowling. In this array of indicia a "5" represents five pins struck down, and the symbols for a spare and strike are used as they may appear in a regulation bowling score sheet. The indicia "5" is used so that if a player succeeds in getting the play piece 18 in the holes 14*a*, 14*c*, 14*g*, or 14*e* twice in succession he scores a spare. Alternately the numerical indicia can include a number less than five so that a so-called open frame can be scored. Also one of the "STRIKE" or "SPARE" holes can be a "GUTTER BALL" hole to add interest to the game and bring it closer to reality for the below-average player.

FIG. 5 illustrates a second overlay 44*a* which can be a separate sheet or the reverse side of the overlay 46. In this instance, the game of tennis is illustrated by the various indicia 20*b* and the holes 14 conform to the holes 14 in pattern and size that are illustrated in FIG. 1. In this array of indicia the total number of "POINT" holes equals the total number of "FAULT" or "ERROR" holes and the balance is offset by the "DOUBLE FAULT" hole 14*f* at the bottom of the overlay 42*a.*

It is apparent from this description that the overlay panel pieces 44 shown in FIGS. 4, 4A and 5 can be used with the embodiment shown in FIG. 3 without the necessity of the tab 42 as long as the outer edge snap-fits into engagement with the inner surfaces 32 and 40 of the flange 22. If the player's thumb is pressed against the extension 48, the panel 44 does not have to snap-fit into these inner surfaces. However, in this instance, each time the racquet is moved downwardly the overlay sheet will flop upward and then return to its contiguous position against the play surface 12*a.* This action, however, does not interfere with play.

What is claimed is:

1. A racquet and play piece combination comprising:

a generally shperical, resilient play piece;

a racquet having a handle portion and a flat body portion;

a plurality of space-apart holes in said flat body having diameters less than the diameter of said play piece;

a peripheral flange extending symmetrically around and above the side edge of said flat body portion;

the spaces between any adjacent pair of said holes and the spaces between the outermost of said holes and said flange providing a planar playing surface on each side upon which said piece can roll and bounce;

said plurality of spaced-apart holes is arranged in a pattern having peripheral holes substantially equally spaced circumferentially inside said flange;

said flange includes an inner face defining an edge spaced above said flat body portion for rolling point contact with said play piece;

the radial distance between said rolling point contact and the outermost edge of said peripheral holes being such that the rolling contact of said play piece on said supporting surface is in the proximity of the outermost edge of said peripheral holes to increase the chance of deflection of said play piece as it rolls thereby; and, indicia adjacent each of said holes on each side of said flat body portion designating the events of a game.

2. A racquet and play piece combination in accordance with claim 1 including:

a flat flexible panel piece having holes therein conforming to the holes in said flat body portion, the peripheral edge of said panel being adapted to slip-fit within said flange on either side of said flat body portion; and, different indicia adjacent each of the holes in said panel whereby a different series of events for said game is presented.

3. A racquet and play piece combination in accordance with claim 2 in which:

said panel includes different indicia on each side thereof whereby two different games can be played.

4. A racquet and play piece combination in accordance with claim 1 in which:

at least one of said peripheral holes is positioned in relation to said flange edge such that said rolling point contact of said play piece is inside the outermost edge of said peripheral hole to cause the deflection of said play piece as it rolls thereby.

5. A racquet adapted to catch a spherical play piece including:

a flat body portion of generally circular configuration having a handle portion;

a plurality of holes in said flat body portion;

said holes being spaced from each other and from the periphery of said flat body portion;

a flange encircling the periphery of said flat body portion;

each of said holes having identifying indicia; and, means to change the indicia including an overlay panel of opaque sheet material having holes therein identically corresponding to the holes of the flat body portion when the overlay is placed on said body with different indicia thereon for each of said holes;

said panel being adapted to snap-fit into the inside of said flange.

6. A racquet in accordance with claim 5 in which;

said overlay panel includes a portion that extends into said handle portion into a position to be retained by a finger of the user during play.

7. A racquet in accordance with claim 5 in which;

a tab member is provided on the inside of said flange and spaced above the surface of said flat body portion whereby the edge of said overlay piece fits into said space to retain said overlay piece at one point of its periphery.

8. A racquet in accordance with claim 5 in which:

said flange includes an inner off-set wall extending around the periphery of said flat body portion; and, said off-set providing a corner for point contact with said play piece.

9. A racquet in accordance with claim 5 including:

a plurality of said tab members extending from said peripheral flange; and, at least one of said tab members defining a point of contact with said spherical play piece whereby to cause its erratic deflection during play.

10. A racquet and play piece combination for use in playing four different games comprising:

a generally spherical, resilient play piece;

a racquet having a handle portion and a flat body portion;

a plurality of spaced-apart holes in said flat body portion having diameters less than the diameter of said play piece;

a peripheral symmetrical side flange extending around and above each side of said flat body portion;

the spaces between any pair of adjacent holes and the spaces between the outermost of said holes and said flange defining a planar playing surface on each side of said flat body portion upon which said play piece can roll and bounce;

indicia adjacent each of said holes on each side of said flat body portion designating the events for two different games to be played during the catching of said play piece with said racquet;

said flange defining an inner wall substantially normal to said flat body portion; and a flat opaque flexible panel having holes therein conforming to the array of holes in said flat body portion;

said panel having different indicia on each of its sides adjacent said holes to designate two additional games to be played;

the peripheral edge of said panel fitting into juxtaposition with the inner wall of said flange whereby to be retained thereby in a snap-fit relationship during play.

11. A racquet and play piece combination in accordance with claim 10 in which:

said flange includes an inwardly protruding tab member on its inner wall spaced above said flat body portion and longitudinally from said handle portion;

said panel including an extension that lays against said handle portion of said racquet in a position to be retained by the hand of a player; and, the peripheral edge of said panel extends into the space under said tab whereby to provide a second point of retention for said panel during play.

* * * * *

UNITED STATES PATENT OFFICE

CERTIFICATE OF CORRECTION

PATENT NO. : 3,990,702
DATED : November 9, 1976
INVENTOR(S) : PETER G. CHOPP

It is certified that error appears in the above-identified patent and that said Letters Patent are hereby corrected as shown below:

Column 6, line 29, after "generally" delete "shperical" and insert ---- spherical ----; and, Column 8, line 30, after "additional" insert ---- different --.

Signed and Sealed this

Eleventh Day of January 1977

[SEAL]

*Attest:*

RUTH C. MASON
*Attesting Officer*

C. MARSHALL DANN
*Commissioner of Patents and Trademarks*